US008328034B2

(12) United States Patent
Miros et al.

(10) Patent No.: US 8,328,034 B2
(45) Date of Patent: Dec. 11, 2012

(54) FOOD CONTAINER

(75) Inventors: Robert H. J. Miros, Fairfax, CA (US); Caroline S. Miros, Fairfax, CA (US)

(73) Assignee: 3rd Stone Design Inc., San Rafael, CA (US)

( * ) Notice: Subject to any disclaimer, the term of this patent is extended or adjusted under 35 U.S.C. 154(b) by 425 days.

(21) Appl. No.: 12/480,600

(22) Filed: Jun. 8, 2009

(65) Prior Publication Data

US 2010/0308039 A1 Dec. 9, 2010

(51) Int. Cl.
*B65D 6/28* (2006.01)

(52) U.S. Cl. ..... 220/4.22; 220/23.86; 220/23.88; 426/115; 426/119

(58) Field of Classification Search ..... 220/23.86, 220/23.88, 500, 507, 556, 4.22, 4.23, 4.24, 220/526, 23.87, 23.89, 23.83; 206/459.5, 206/541, 542, 288; 426/115, 119, 120
See application file for complete search history.

(56) References Cited

U.S. PATENT DOCUMENTS

| | | | | |
|---|---|---|---|---|
| 3,016,129 | A * | 1/1962 | King, III | 206/545 |
| 3,289,996 | A | 12/1966 | Inman | |
| 3,799,386 | A * | 3/1974 | Madalin et al. | 206/564 |
| 5,094,355 | A * | 3/1992 | Clark et al. | 220/4.23 |
| 5,337,918 | A * | 8/1994 | Wang | 220/708 |
| 5,396,999 | A * | 3/1995 | Sandheinrich | 206/542 |
| 5,950,834 | A * | 9/1999 | Woodnorth et al. | 206/541 |
| 6,144,016 | A * | 11/2000 | Garvin | 219/387 |
| 6,920,980 | B2 * | 7/2005 | Hwang et al. | 206/470 |
| D524,646 | S * | 7/2006 | Hellenbrand et al. | D9/756 |
| D524,662 | S * | 7/2006 | Fager et al. | D9/756 |
| D616,258 | S | 5/2010 | Miros et al. | |
| 2004/0026430 | A1 * | 2/2004 | Baker et al. | 220/575 |
| 2005/0109776 | A1 * | 5/2005 | Camp, Jr. | 220/23.86 |
| 2006/0201950 | A1 | 9/2006 | Liu | |
| 2008/0128424 | A1 | 6/2008 | Castellanos et al. | |
| 2009/0140032 | A1 * | 6/2009 | Cai et al. | 229/120.18 |
| 2011/0315595 | A1 * | 12/2011 | Gassick et al. | 206/557 |

FOREIGN PATENT DOCUMENTS

WO WO 2010/144179 12/2010

OTHER PUBLICATIONS

International Patent Application No. PCT/US2010/031086 filed Apr. 14, 2010 in the name of 3rd Stone Design Inc., International Search Report and Written Opinion mailed Jun. 16, 2010.

* cited by examiner

*Primary Examiner* — Mickey Yu
*Assistant Examiner* — Kareen Rush
(74) *Attorney, Agent, or Firm* — Levine Bagade Han LLP

(57) ABSTRACT

A lunch box assembly having a main housing having a lid rotatably, hingedly attached to a base to provide access to an opened interior of one or more compartments is disclosed. The lid can have ferrously magnetic material and recesses to accept magnets. The magnets can be shaped to fit the recesses. The base can have compartments aligned with corresponding compartments in the lid. The base and the lid can form one or more closed food storage compartments that separate the contents from the neighboring compartments. A latch on the base and lid can produce a clamping force on a small lidded container or containers placed in one or more of the compartments. The clamping force can clamp the lidded container closed and prevent leakage of fluids in the container.

9 Claims, 7 Drawing Sheets

FOOD CONTAINER

BACKGROUND OF THE INVENTION

1. Field of the Invention

The present invention relates to a lunch box, and more particularly to a lunch box for storing and transporting food in such a manner that it will not spill or comingle. The lunch box can have attachable elements that allow the lunch box to be customized to the individual owner. The lunch box can be made of a durable material and used repeatedly, for example reducing waste associated with disposable food containers. The lunch box may be used on a daily basis for taking food to school, work, and other destinations.

2. Description of the Prior Art

Lunch boxes as containers for transporting food have been used in many cultures for now hundreds of years. Many lunch boxes have been comprised of metal such as stamped tin, stainless steel or folded aluminum. Lunch boxes have been used to transport all variety of meals for consumption at the worksite, at school or on other outings away from a household kitchen or restaurant.

The conventional structure of a lunch box is that of a container for storing food therein with a hinged lid that closes the lower portion of the container and secures the contents. Other variants of this same type of container may have separate, individual containers that nest inside of the larger lunch box body and have independently closed lids that secure the food contents.

Since the mid-1970's the use of plastic polymers has changed the design and construction of lunch boxes significantly. Many of the individual compartments used for food storage are molded directly into the body of the lunch box and the hinged lid is often an integral element to the entirety of the assembly. This type of polymer construction also tends to present a less durable product that often breaks after less than a year's use. In addition to simple plastic lunch boxes there have also been many attempts to add features and capabilities to the common lunch box, these include the addition of a heating or warming element to the box itself to warm one's meal, the addition of cooling elements and insulation to keep foodstuffs fresh, and the use of transparent materials to allow for easy identification of contents.

Current lunch boxes, whether metal or plastic, present some challenges for the typical user especially when that user is a child or adolescent. The desire to personalize a product is commonplace for personal items carried and used by children. This desire to personalize or customize often manifests itself in the application of stickers to ones lunch box or creative coloring or through the use of a carrying bag that shows a beloved movie or storybook character. Indeed many children's movie promotion campaigns will even include the design and manufacture of customized lunch boxes to promulgate the characters in the film. Thus the need for personalization of lunch boxes is well known and clearly demonstrated in the marketplace. Another challenge to the users of common lunch boxes is the containment of liquid foods within the lunch box itself. Several designs exist for separate soup or liquid food containers. These often have threaded lids with integral seals and may also have insulated walls to keep contents hot or cold throughout the day. These purpose specific containers are often quite bulky and expensive and seemingly overly complex for the simple transport of a liquid food such as yogurt or salad dressing. This gives rise to a second important shortcoming of commercially available lunch boxes which is the lack of simple means for liquid food containment.

Therefore, a lunch box to transport and store food while reducing the likelihood of the food comingling combined with ability to customize the container to the individuals tastes is desired.

SUMMARY OF THE INVENTION

A lunch box assembly with an integral lid and separate interior compartments for the storage and transport of food in such a manner so that the foods will not comingle is disclosed. A lunch box in which liquid foods may be stored in small containers that provide a liquid tight seal that are in turn held closed by the lunch box assembly during transport is also disclosed. In addition, a lunch box that can be personalized through the addition of graphic elements in the form of magnet attachments to the exterior is disclosed. Further disclosed is a lunch box that forms an integral kit with an outer case or box, interior containers for liquid food storage, and graphic attachments in the form of magnets that allow for personalization of the complete set.

The lunch box can be a durable, reusable food container for transport and storage of meals. The lunch box can be self-contained. The lunch box can transport food and serve as a food serving surface.

The lunch box can minimize or prevent comingling of foods by virtue of having extruded, internal compartments with walls that meet at opposing points with the closed assembly of the lid and tray. The lunch box can minimize heat transfer between compartments by separating compartments by gaps of air or other insulating material.

The lunch box can have a latch and hinge assembly to close the lid and tray. The latch assembly can hold the lip against the tray under tension.

The lunch box can be used with lidded containers. The lidded containers can have seals that can prevent leaking of liquids. The compressive force created by the latch assembly between the lid and tray portions of the assembly can clamp the lidded containers closed and sealed.

The lunch box can have raised retention dots in the tray and/or lid to hold the lidded containers in place laterally within one or more compartments of the closed assembly. The retention dots can prevent or minimize shifting of the lidded containers during transport.

The lunch box lid can have a configuration to seat flexible magnets. The magnets can be decorative, promotional or informative regarding the contents of each compartment. For example, the user can personalize their lunch box with magnets. The magnets can be used as identifying elements to distinguish one user's lunch box from another's through the use of personalized elements. The magnets are attracted to the lid of the lunch box by the presence of ferromagnetic material in the base material used to construct the lid.

DETAILED DESCRIPTION

Figure 1:
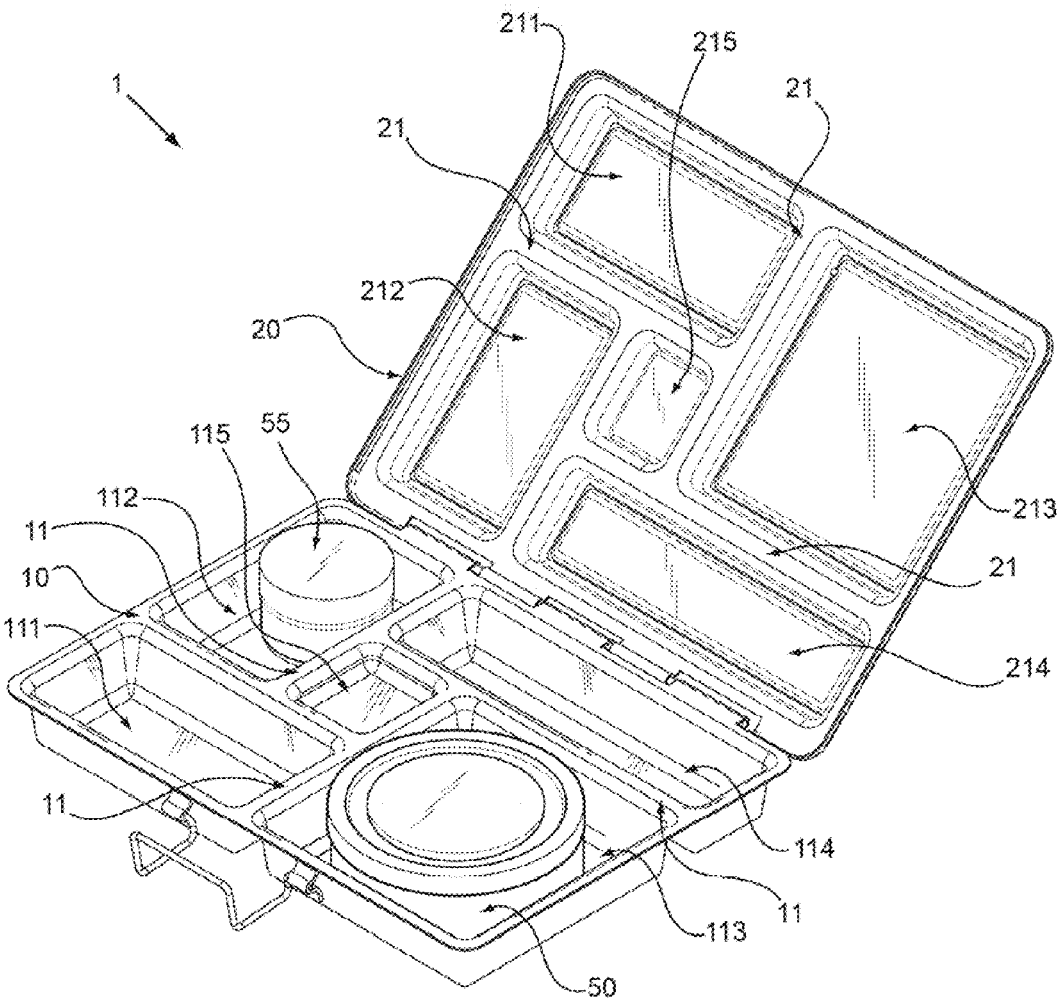
FIG. 1 is a perspective view of a variation of the food container with the lid open and lidded containers placed therein.
Figure 2:
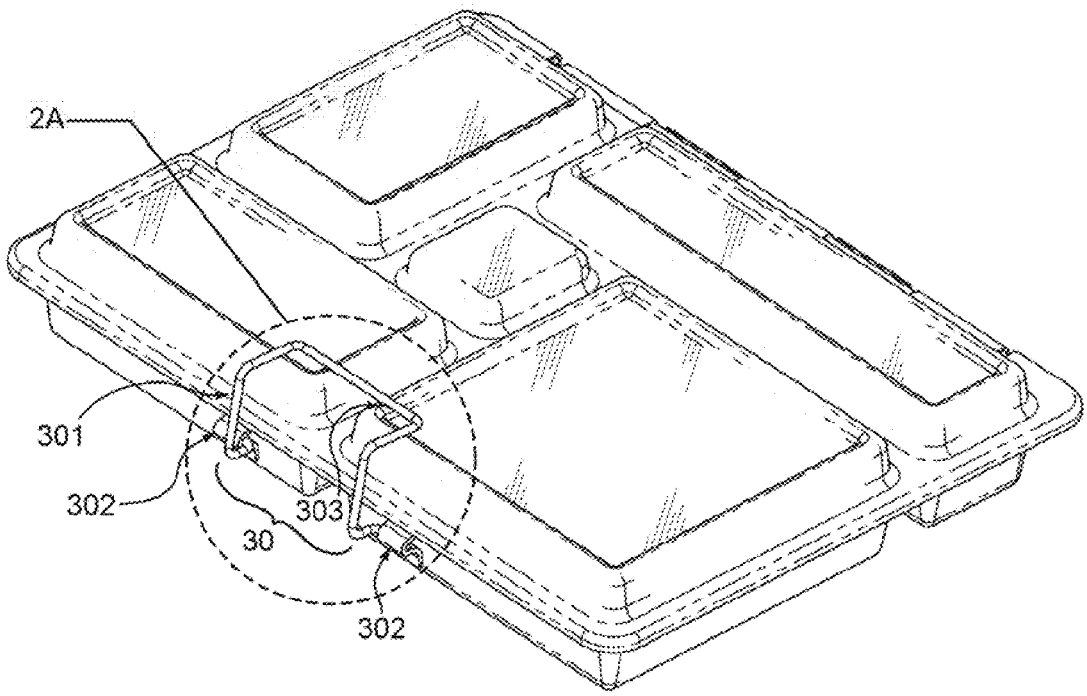
FIG. 2 is a perspective view of a variation of the food container with the lid closed and the latch in a closed position.
Figure 3:
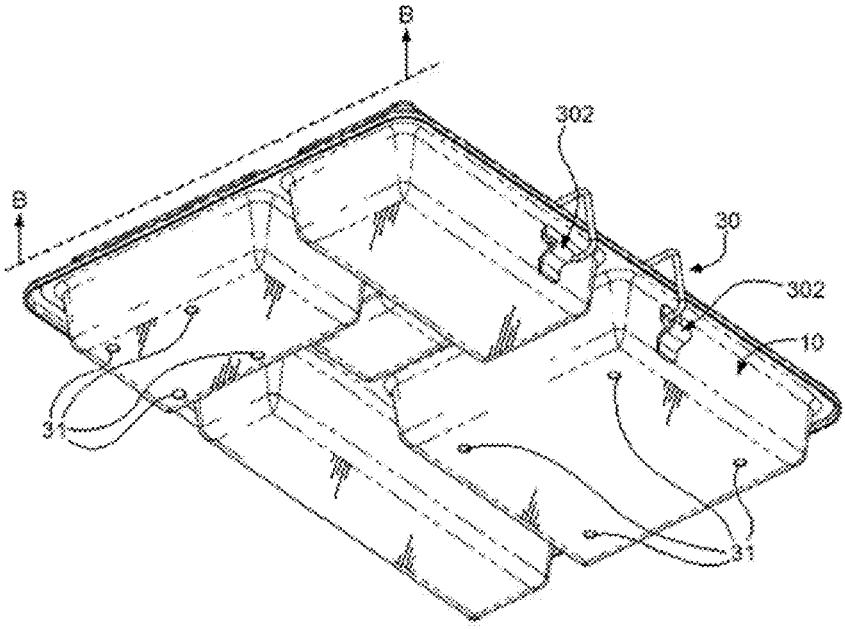
FIG. 3 is a bottom perspective view of a variation of the food container showing the bottom of the tray having retention features used in aligning the internally placed lidded containers.

FIG. 1 illustrates that the food container can be a lunch box 1 that can be in an opened configuration. FIGS. 2 and 3 illustrate that the lunch box 1 can be in a closed configuration. The lunch box 1 can have a first housing and a second housing. The first housing can be a door, lid or bottom tray 10. The second housing can be a door, tray or upper lid 20, for example, able to cover the bottom tray 10. The housings can be made from durable materials, for example, a metal such as steel, or a hard plastic. The lid and/or tray can be made from a ferromagnetic material, such as a steel and/or a hard plastic having a ferromagnetic powder embedded in the plastic.

The tray 10 can have dividing walls 11. The dividing walls 11 can divide the tray 10 into a plurality of compartments 111, 112, 113, 114, and 115. Each of the compartments 111, 112, 113, 114, 115 can have a depth for receiving food of various size and shape.

The lid 20 can be formed with upwardly extruded volumes 211, 212, 213, 214, and 215 or compartments. The extruded volumes 211, 212, 213, 214, and 215 can be located in corresponding opposition to the downwardly extruded compartments 111, 112, 113, 114, and 115, respectively, of the tray 10. The extruded volumes in the lid can have an extruded volume height sufficient for food mounded up in the lower tray 10 to have space in the upper volume of the lid so as not to be displaced by the closure of the lid 20.

The dividing walls 11 of the tray 10 can be formed by the downward extrusion of the compartments 111, 112, 113, 114, and 115 so the top surface of the dividing walls 11 can be flush and with the top surface of the perimeter of the tray. The top surface of the dividing walls of the tray can seal against the dividing walls 21 of the lid 20. The seal can be water-tight or content-tight. For example, content tight can include when the lunch box is in a closed configuration, the top surface of the dividing walls of the tray can abut or approach the dividing walls 21 of the lid 20 to prevent or minimize shifting or moving of the contents (e.g., food) of the compartments from compartment to compartment during transport and use.

FIG. 2 shows that the closure latch assembly 30 can be in a secured position retaining the lid 20 in close contact to the tray 10. The latch assembly can deliver a force compressing the tray to the lid. The latch assembly can deliver a tensile force pulling the tray and the lip together. The latch assembly 30 can have a latch bail 301 or clasp and latch hasps 302 that can attach the latch bail to the bottom tray 10. When the lunch box is closed, the latch assembly 30 can impart a spring force to the lid 20 with the wire formed bail 301. The wire form bail 301 can rotate into position over the lid 20. The wire form bail 301 can snap into place on the lid in a small indentation 303 on the lid.

Figure 2A:
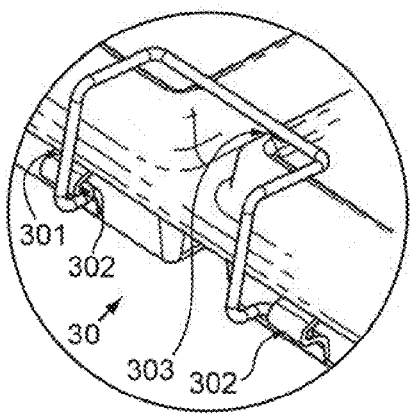
FIG. 2A is a variation of close up 2A of FIG. 2.

FIG. 2A illustrates that the latch bail 301 can be in a latched configuration. In the latched configuration the latch bail 301 can be secured to the lid 20. The latch bail 301 can be under tension in contact with the indentation 303. The indentation can pressure fit or interference fit the latch bail 301 in place, or otherwise prevent unlatching, during use (e.g., and transportation of the lunch box).

The latch hasps 302 can hold the latch bail 301 in tension in relationship to the tray 10 of the lunch box. The tension in the latch assembly 30 when closed can deliver or impart a closure force between the lid 20 and the tray 10. The closure force can prevent or minimize accidental dislodging of the latch assembly 30 during transport. The closure force can impart a sealing force to the lidded containers 50, 55 placed inside the assembly. For example, the sealing force can press the top surface of the dividing walls 11 against the top surface of the perimeter of the tray.

FIG. 3 is a bottom perspective view of the lunch box. The latch assembly 30 can include the latch hasps 301 that can be attached to the side wall of the bottom tray 10. The retention dots 31 can laterally interference fit against the lidded containers 50, 55. The retention dots 31 can prevent the lidded containers 50, 55 from moving side-to-side inside the lunch box during use. The retention dots can be dimples pressed into the bottom walls of one or more of the compartments. The retention dots can have an inwardly extruded dome-like or hemi-spherical surface on the inside of the bottom walls of the compartments in the lower tray 10. The retention dots 31 can be located at the corners of a square that circumscribes the circular profile of the lidded containers 50, 55.

Figure 3A:
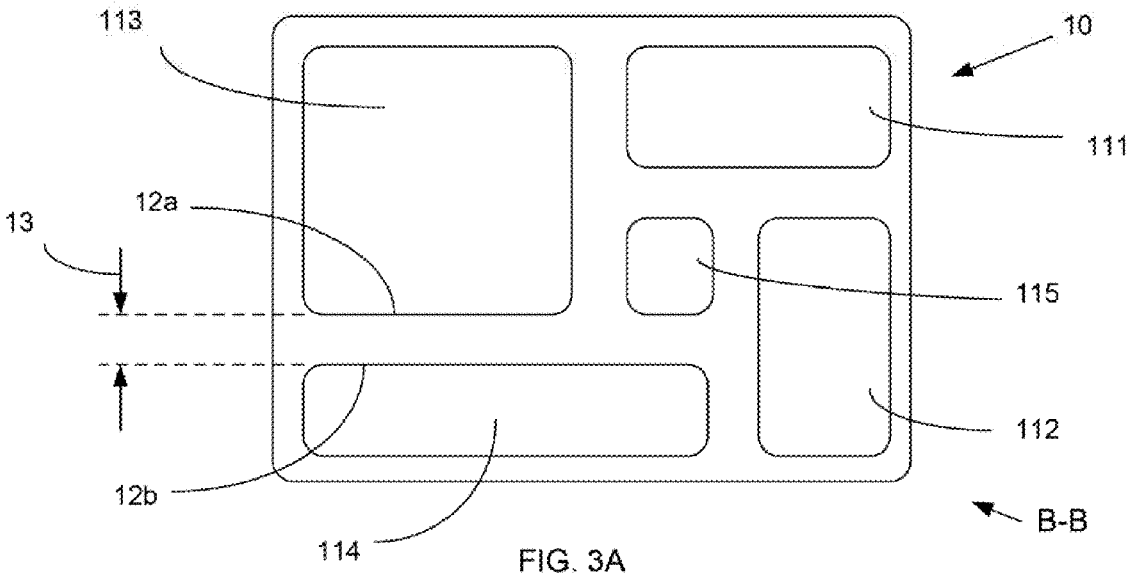
FIG. 3A is a variation of a two-dimensional section taken from a sectional line B-B of FIG. 3.

FIG. 3A illustrates that the dividing walls 11 can have a first dividing wall edge 12*a* and a second dividing wall edge 12*b*. The first dividing wall edge 12*a* and the corresponding second dividing wall edge 12*b* of the adjacent compartment can be separated by a compartment gap 13. The compartment gap 13 between each adjacent compartments can be the same or different as the compartment gaps 12 between any other adjacent compartments. The compartment gap 13 can be from about 0.254 cm (0.100 in.) to about 5 cm (2.0 in.), for example about 0.254 cm (0.100 in.) or about 0.64 cm (0.25 in.), or about 1.3 cm (0.50 in.).

Figure 4:
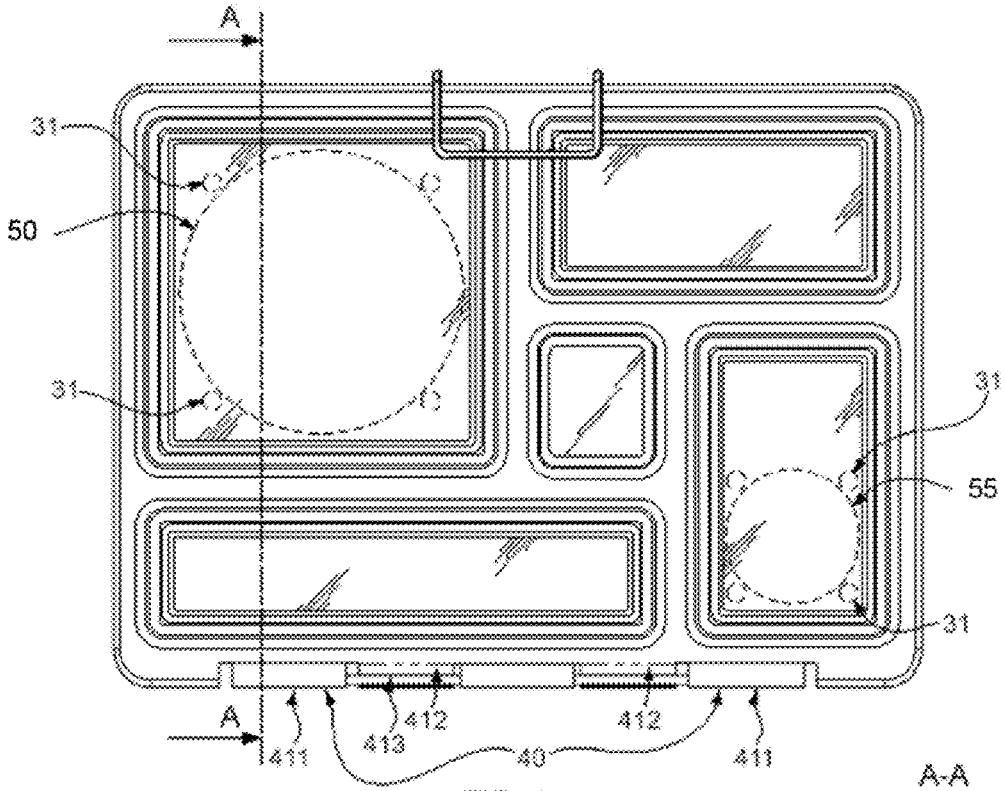
FIG. 4 is a top plan view of a variation of the food container showing dashed line circles to indicate the location of the lidded containers therein.

FIG. 4 illustrates that the enclosed lidded containers 50 and 55 can be inside separate or the same compartments of the lunch box. The lidded containers 50 and 55 can be laterally restrained by the retention dots 31. The retention dots 31 can position and hold the lidded containers 50 and 55 when the lidded containers 50 and 55 placed inside the lunch box assembly 1. The lidded container can be placed laterally within the retention dots.

The hinge assembly 40 can be integrally formed by the meeting of the edges of the top lid 20 and the bottom tray 10 and the interposition of a hinge rod 413. The bottom tray can have one or more protruding tabs of bottom hinge wrap 412. The bottom hinge wrap 412 can wrap around the hinge rod 413. The top lid 20 can have one or more protruding tabs of top hinge wrap 411 that can wrap around the hinge rod 413. The hinge wraps 411 and 412 can create a piano hinge. The hinge assembly 40 can rotate by fixedly connecting the tabs 411 on the tray 10 to the hinge rod 413. The opposing tabs 412 attached to the lid 20 can be wrapped tightly around the hinge rod 413 but left with enough clearance such that they can freely move thus imparting a rotational and/or translational motion to the lid 20 in relationship to the tray 10.

Figure 4A:
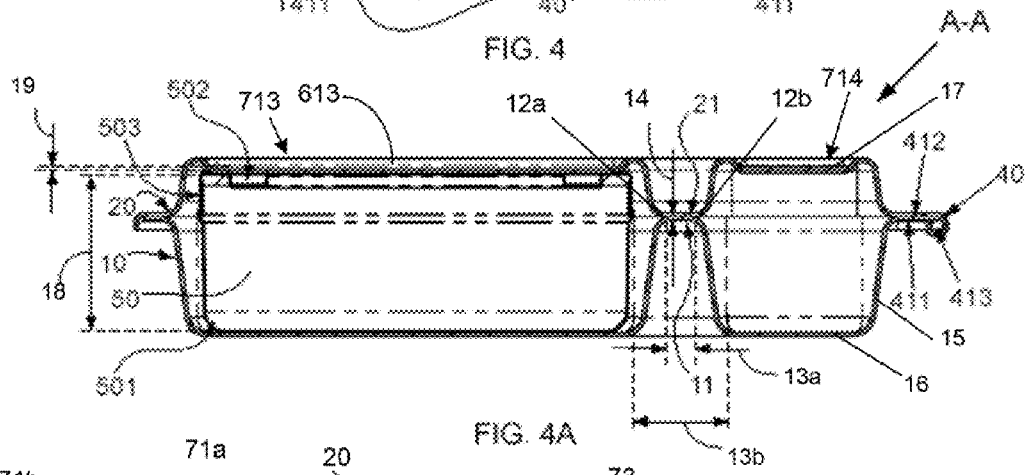
FIG. 4A is a sectional view taken from a sectional line A-A of FIG. 4 of a variation of the food container containing the larger of the two lidded containers to prevent the lid from being opened.

FIG. 4A shows that the lower dividing walls 11 can meet the upper dividing walls 21 to prevent the shifting or movement of the contents of the individual compartments 111, 112. The dividing wall gap 14 between the lid dividing wall 21 and the base dividing wall 11 can be about 0 cm (0 in.). For example, the dividing wall gap can be substantially closed when the lunch box is in a closed configuration.

The lidded container 50 assembled with its constituent parts 501, 502, 503 can be placed between the bottom tray 10 and the upper lid 20. The lidded container 50 can be closed. The seal 502 can be engaged with the lid 503 and the cup 501. The lidded container 50 is squeezed together by the interior surface of the compartment 113 and the interior surface of the upper compartment 213 which is in the lid 20. This compression of the lidded containers 50, 55 is maintained through the closure of the latch assembly 30 working in concert with the hinge assembly 40 to hold the lid 20 and the tray 10 in close contact to one another.

The compartment gap 13 can vary along the side walls 15 of the compartments from a first, minimum compartment gap 13*a* to a second, maximum compartment gap 13*b*. The maximum compartment gap 13*b* can be from about 100% to about 300% of the minimum compartment gap 13*a*. For example, the maximum compartment gap 13*b* can be about 125%, 150% or 200% of the minimum compartment gap 13*a*.

The compartment gaps can be outside or external of the volume formed by the closed lid and tray. The compartment gap can be open or exposed to the environment outside of the lunch box.

The compartments can have side walls 15, bottom walls 16 and top walls 17. The container can have a container height 18. The container height 18 can be about equal, marginally greater than or marginally less than the distance from the inside of the bottom wall 16 to the inside of the top wall 17 when the lunch box is in a closed configuration. The top wall 18 and the bottom wall 17 can exert a compressive clamping force on the top and bottom of the containers.

The lid can have a panel recess (shown as 713 and 714 in FIG. 4A) on the lid above some or all of the tops of the compartments. The panel recess can be configured to hold a magnetic panel 613 and exert a lateral resistance or interference against the shifting of the magnetic panel 613. The panel recess can define a raised complete or partial boundary around the perimeter of the magnetic panel 613.

The magnetic panel 613 can be magnetic. The magnetic panel can be substantially flat. For example, the magnetic panel height 19 can be from about 0.02 cm (0.001 in.) to about 0.25 cm (0.10 in.).

Figure 4B:
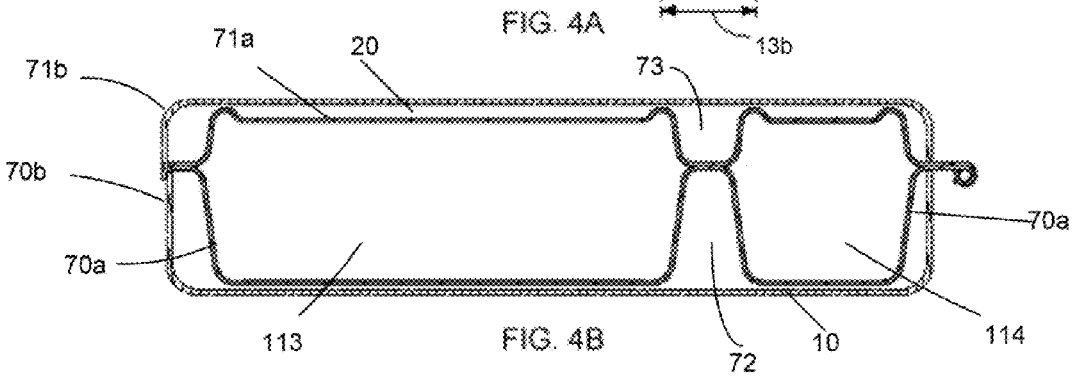
FIG. 4B is a sectional view taken from a sectional line A-A in FIG. 4 of a variation of the food container that can have an insulating layer.

FIG. 4B illustrates that the tray 10 can have a tray inner surface 70*a* and a tray outer surface 70*b*. The tray inner surface can be directly or indirectly fixed to the tray outer surface. The lid 20 can have a lid inner surface 71*a* and a lid outer surface 71*b*. The lid inner surface can be directly or indirectly fixed to the lid outer surface.

The volume between the tray inner surface and the tray outer surface can be filled with a tray insulating material 72. The volume between the lid inner surface and the lid outer surface can be filled with a lid insulating material 73. The tray insulating material and the lid insulation material can be the same or different materials. The lid and/or tray insulating materials can be air, water, saline solution, Styrofoam, plastic, a plastic honeycomb, or combinations thereof.

The tray inner surface 70*a*, tray outer surface 70*b*, lid inner surface 71*a* and lid outer surface 71*b* can be the same or different materials. For example, the tray and/or lid inner and/or outer surfaces 70*a*, 70*b*, 71*a* and/or 71*b* can be any of the insulating materials, or a metal such as a steel.

The tray and/or lid inner and/or outer surfaces 70*a*, 70*b*, 71*a* and/or 71*b* and/or the insulation materials 72 and/or 73 can be ferromagnetic, for example containing steel or a ferromagnetic powder.

Figure 5A:
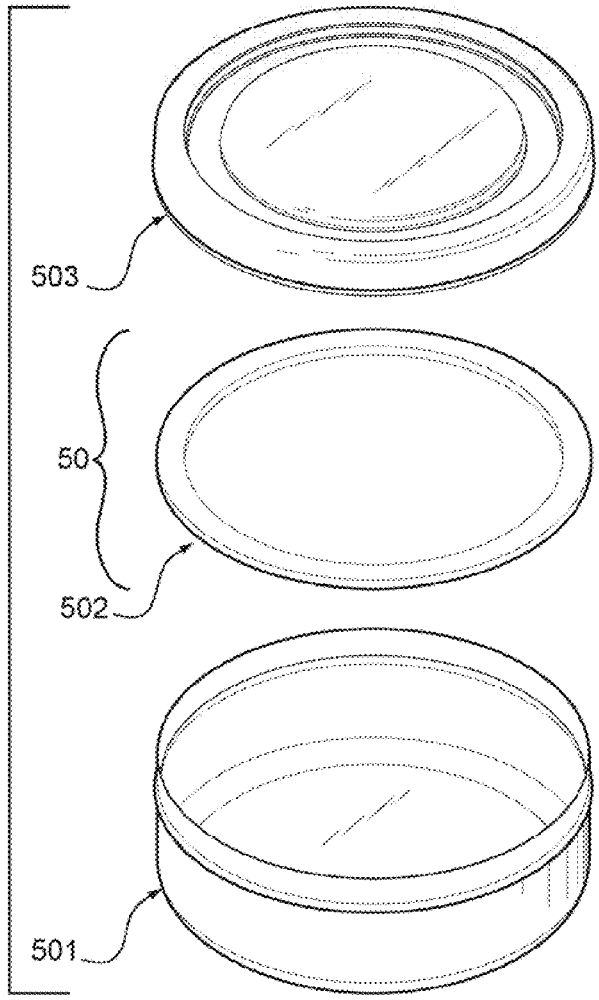
FIG. 5A is an exploded assembly view of the larger of two lidded containers used inside the present invention.
Figure 5B:
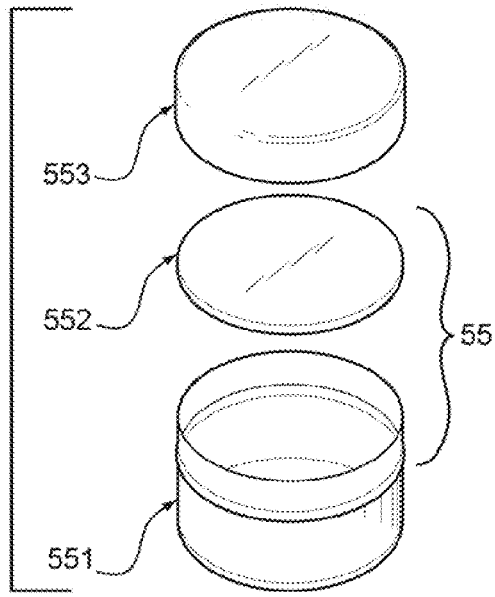
FIG. 5B is an exploded assembly view of the smaller of two lidded containers used inside the present invention.

FIGS. 5A and 5B depict the assemblies of the lidded containers 50 and 55 or sub-containers. These containers are intended for the storage and transport of liquid foods such as yogurt, salad dressing, and apple sauce. The containers can have a cup 501, 551, a lid 503, 553, and an elastomeric sealing gasket 502, 552. The sealing gasket can form a liquid tight seal between the cup and the lid. The seal can be formed between the lid and the cup of the container by the compression of the cup and the lip with or without a gasket. The gasket can be made from silicone, urethane, polyethylene, PVC, EPDM, TPE, neoprene, or combinations thereof. The cup and lid can be interchangeable. The cup and lid can be equal in size or different sizes. For example, the cup can be larger than the lid or the lid can be larger than the cup.

When assembled these containers will hold liquid foods without leaking provided that the lid 503, 553 is held in close contact with the gasket 502, 552 which in turn is pressing against the cup 501, 551.

Figure 6:
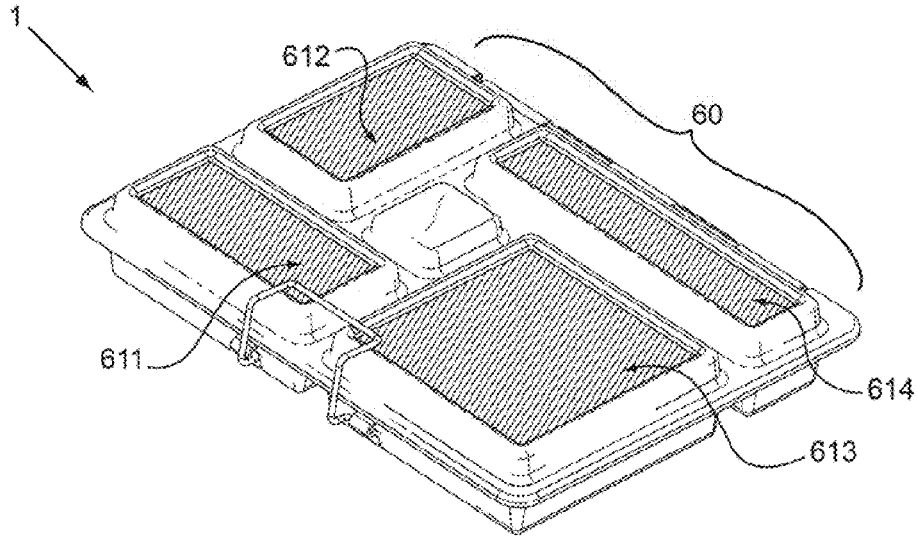
FIG. 6 is a perspective view of a variation of the food container showing the placement of decorative magnets atop the lid portion of the assembly.
Figure 6A:
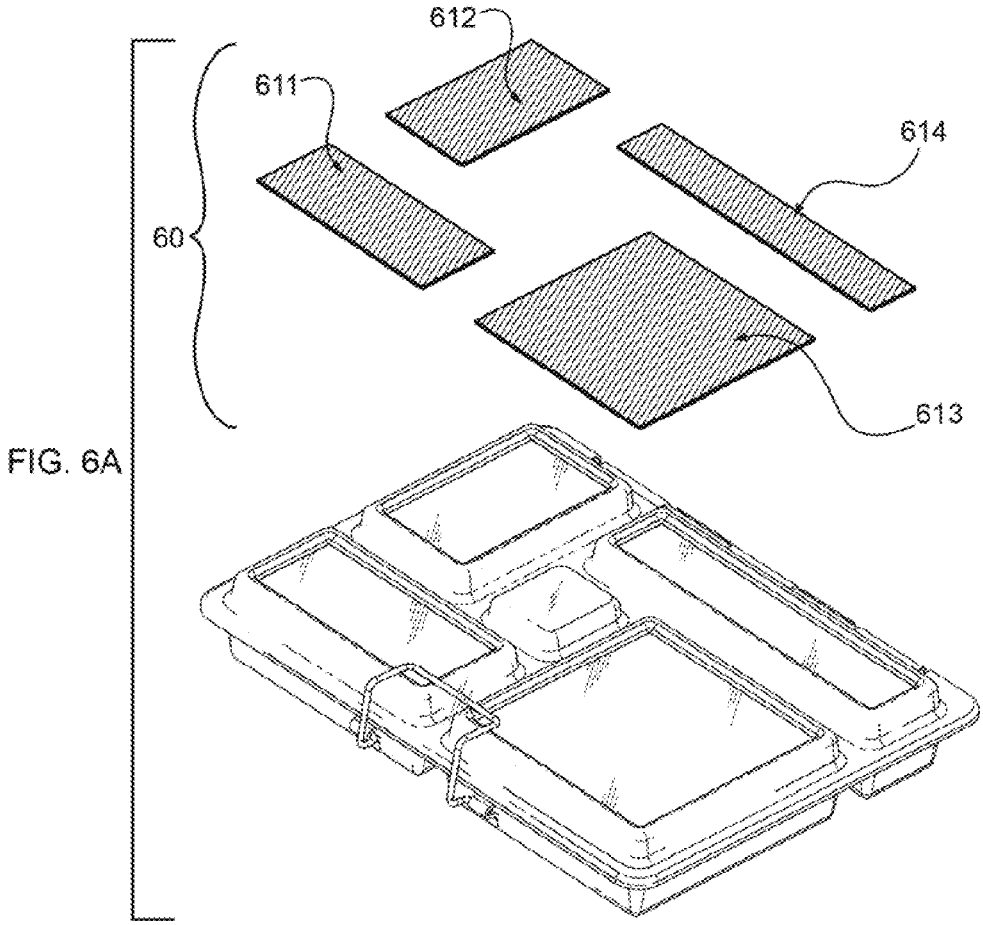
FIG. 6A is an exploded perspective view of a variation of the food container showing the magnets above the recessed portions of the protruding compartments formed in the top lid of the assembly intended for receipt of the magnets in application.

FIGS. 6 and 6A show the closed lunch box 1 with the addition of magnetic panels 60. The magnet panels can be a flexible ferromagnetic material that causes them to hold to the upper lid 20 of the lunch box in a fixed manner. The magnetic panels 60 can be shaped in roughly rectangular forms to match the panel recesses in the lid 20. The individual magnetic panels 611, 612, 613, 614 can align to the recesses on the top surface of the corresponding upwardly extruded sections 211, 212, 213, 214 of the lid 20. The panel recesses can form a partial or complete circumference around the magnet. For example, the panel recess can have four aligned, raised right angle corners that do not extend through the entire side to form a rectangle. The panel recess can have four raised sides, but no corners to form a rectangle.

The magnetic panel can have a top surface that can be configured to be written on by pen ink, pencil graphite, or provide a surface suitable for dry erase markers, or a combination thereof. The top surface (i.e., facing away from the compartment) of the magnetic panel can be printed with information corresponding to the contents of the compartment (e.g., "beans", "salad", "soup"). The top surface of the magnetic panel can be printed with promotional or decorative images.

Figure 7:
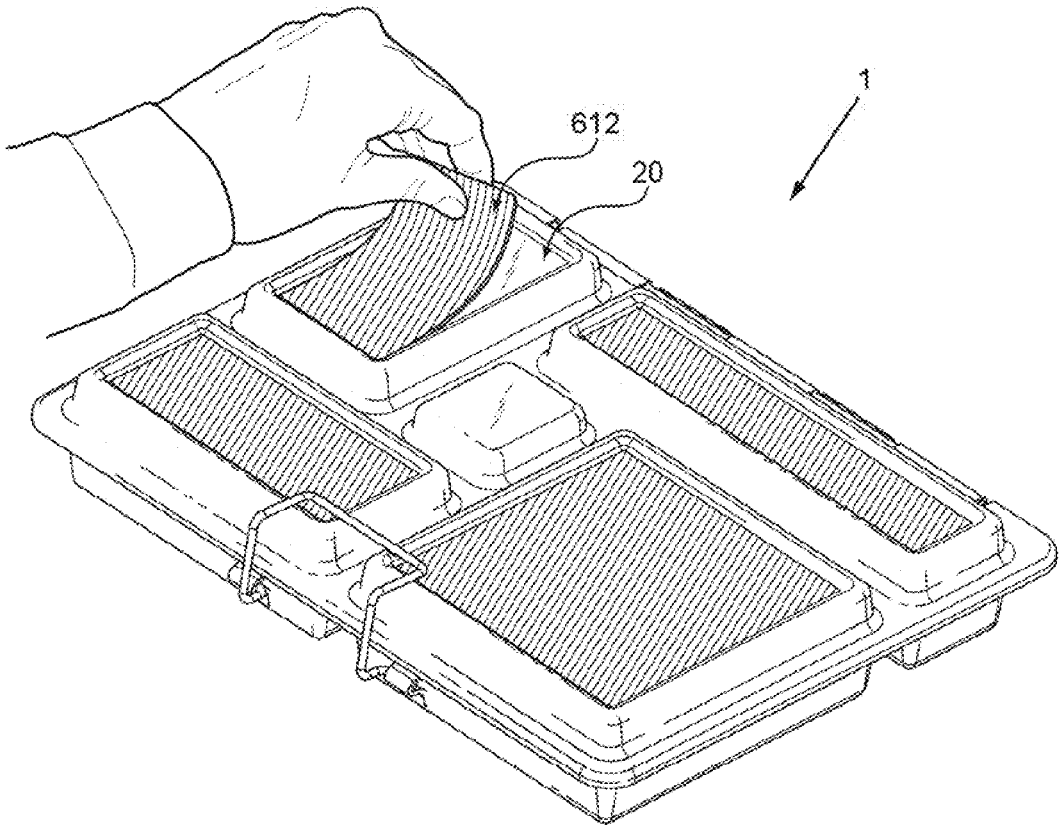
FIG. 7 is a perspective view of a variation of the food container showing the application of the flexible magnets in their intended locations atop the closed lid of the assembly.

FIG. 7 shows one of the magnets 612 being flexibly applied to the lid 20 of the lunch box assembly 1 by the hand of a user. The magnetic panels 611, 612, 613 and 614 can be removed, reapplied, decorated with alternating graphics, or not used at all. The magnetic panels can identify the lunch box and/or compartments and/or be decorative. The magnetic panels 611, 612, 613, and 614 can be retained by the perimeter of the panel 14 recess and by the magnetic attraction to the material of the lid 20. The lid 20 can have retention features on the top surface of the upwardly extruded compartments 211, 212, 213, 214, 215, for example around the perimeters of the panel recesses, that can prevent the magnets from shifting or being dislodged by the handling of the lunch box 1 during use, for example during stowage in a backpack or carrying bag.

The lunch box can store and transport foods while preventing the comingling of contents, sealing liquid food items within self contained lidded containers, and provide a personalization means through the use of magnets atop the lid of the assembly.

The variations above are for illustrative purposes and it will be apparent to those skilled in this art that various equivalent modifications or changes according to the idea of and without departing from the disclosing and teaching of this invention shall also fall within technical scope of the appended claims.

Any elements described herein as singular can be pluralized (i.e., anything described as "one" can be more than one), and plural elements can be used individually. Any species element of a genus element can have the characteristics or elements of any other species element of that genus. The term "comprising" is not meant to be limiting. The above-described configurations, elements or complete assemblies and methods and their elements for carrying out the invention, and variations of aspects of the invention can be combined and modified with each other in any combination.

We claim:

1. A food container comprising:

a first housing comprising a first compartment and a second compartment, a first recess and a second recess; a first magnetic panel removably attached to the first recess; and a second magnetic panel removably attached to the second recess; and a second housing comprising a hinge rotatably attached to the first housing;

wherein the first housing comprises a durable material, and wherein the second housing comprises the durable material; and wherein the first compartment is adjacent to the second compartment, and wherein the first compartment has a first compartment wall adjacent to the second compartment, and wherein the second compartment has a second compartment wall adjacent to the first compartment, and wherein the first compartment wall is separate from the second compartment wall by a first compartment gap, and wherein the first compartment gap extends around the circumference of the first compartment wall; and wherein the first compartment wall is integrated with the second compartment wall across a first dividing wall, and wherein the second housing comprises a third compartment having a third compartment wall and a fourth compartment having a fourth compartment wall, and wherein the third compartment wall is integrated with the fourth compartment wall across a second dividing wall; and wherein the third compartment wall is separate from the fourth compartment wall by a second compartment gap, and wherein the second compartment gap extends around the circumference of the third compartment wall; and wherein the first compartment wall extends in a first direction away from the second dividing wall when the food container is in a closed configuration, and wherein the third compartment wall extends in a second direction away from the first dividing wall when the food container is in a closed configuration.

2. The container of claim 1, wherein the first compartment gap has a compartment gap width of at least about 0.1 in.

3. The container of claim 1, wherein the container has a closed configuration, and wherein the first housing and the second housing define a container volume in the closed configuration, and wherein the first compartment gap is exposed to an environment external to the container volume.

4. The container of claim 1, further comprising a clasp.

5. The container of claim 4, wherein the clasp has a first configuration and a second configuration, and wherein in the first configuration the clasp exerts a clamping force pressing the first housing toward the second housing.

6. The container of claim 1, wherein the durable material comprises a ferromagnetic stainless steel.

7. The container of claim 1, wherein the durable material comprises a metal.

8. The container of claim 1, wherein the durable material comprises a steel.

9. A food container comprising:

a first housing comprising a first compartment and a second compartment a first recess and a second recess;

a second housing comprising a hinge rotatably attached to the first housing;

a first magnetic panel removably attached to the first recess adjacent to the first compartment; and a second magnetic panel removably attached to the second recess adjacent to the second compartment;

wherein the first housing comprises a durable material, and wherein the second housing comprises the durable material; and wherein the first compartment is adjacent to the second compartment, and wherein the first compartment has a first compartment wall adjacent to the second compartment, and wherein the second compartment has a second compartment wall adjacent to the first compartment, and wherein the first compartment wall is separate from the second compartment wall by a compartment gap, and wherein there exists a gap between the first compartment wall and all walls extending from the first housing; and a sub-container comprising a cup and a lid, wherein the sub-container is removably positioned between the first housing and the second housing;

wherein the first housing, second housing and cup are configured so that the first housing and the second housing clamp the lid to the cup when the first housing and the second housing move to a first configuration, and wherein the sub-container is contained within a container volume defined by the first housing and the second housing; and wherein the first compartment wall is integrated with the second compartment wall across a first dividing wall, and wherein the second housing comprises a third compartment having a third compartment wall and a fourth compartment having a fourth compartment wall, and wherein the third compartment wall is integrated with the fourth compartment wall across a second dividing wall; and wherein the third compartment wall is separate from the fourth compartment wall by a second compartment gap, and wherein the second compartment gap extends around the circumference of the third compartment wall; and wherein the first compartment wall extends in a first direction away from the second dividing wall when the food container is in a closed configuration, and wherein and the third compartment wall extends in a second direction away from the first dividing wall when the food container is in a closed configuration.

* * * * *